US007119499B2

(12) United States Patent
Ishigaki et al.

(10) Patent No.: US 7,119,499 B2
(45) Date of Patent: Oct. 10, 2006

(54) SWITCHING POWER DEVICE

(75) Inventors: Yuzo Ishigaki, Hamamatsu (JP); Masao Noro, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 11/239,496

(22) Filed: Sep. 29, 2005

(65) Prior Publication Data

US 2006/0066264 A1 Mar. 30, 2006

(30) Foreign Application Priority Data

Sep. 30, 2004 (JP) ..... 2004-288204

(51) Int. Cl.
*H05B 41/36* (2006.01)

(52) U.S. Cl. ..... 315/291; 330/10; 330/251; 363/18; 363/19

(58) Field of Classification Search ..... 315/291, 315/294; 330/10, 251; 363/16, 18, 19
See application file for complete search history.

(56) References Cited

U.S. PATENT DOCUMENTS 6,388,514 B1 * 5/2002 King et al. ..... 330/10
6,690,586 B1 * 2/2004 Hosotani et al. ..... 363/19
2003/0011324 A1 * 1/2003 Lee ..... 315/291

FOREIGN PATENT DOCUMENTS

JP 5176532 7/1993
JP 7274388 10/1995

* cited by examiner

*Primary Examiner*—Tho Phan
(74) *Attorney, Agent, or Firm*—Pillsbury Winthrop Shaw Pittman LLP

(57) ABSTRACT

A switching power device uses a non-capacitor flyback converter circuit not provided with a smoothing input capacitor having a large capacity. Therefore, a power harmonic can be suppressed and a rush current preventing element is not required. A fluctuation in an output current to be supplied to a load is fed back to the non-capacitor flyback converter circuit by a feedback circuit at a lower speed than an input AC frequency. Therefore, it is possible to improve a power factor by causing an input AC current to be proportional to an input AC voltage. A voltage control circuit controls an output voltage so as to have a constant voltage, and the output voltage is dropped in proportion to an output current when the output current exceeds a threshold. Therefore, it is possible to have the same output characteristic as a power device comprising a low frequency power transformer.

6 Claims, 8 Drawing Sheets

SWITCHING POWER DEVICE

BACKGROUND OF THE INVENTION

The present invention relates to a switching power device for an audio amplifier which comprises a low frequency power transformer, eliminates the respective drawbacks of a power supply and a switching power supply and has both advantages.

As a power device for an audio amplifier, conventionally, there have been used a power device utilizing a low frequency power transformer and a switching power device (for example, see Patent Documents 1 and 2).

Patent Document 1: JP-A-7-274388 Publication

Patent Document 2: JP-A-5-176532 Publication

When designing a power supply for an audio amplifier, it is necessary to take care of the following respects.

1. The audio amplifier is to reproduce a voice at a lower limit (20 Hz) of a voice frequency or less. For this reason, it is necessary to provide a capacitor having a large capacity in the output of the power supply for the audio amplifier.
2. It is desirable that the audio amplifier should satisfy that at least a certain degree of an output is a power harmonic regulating object.
3. The audio amplifier is to pass a temperature test and the temperature test sets, as a rated output, an output in which a distortion rate reaches a specific value when all channels are driven for approximately one minute at the same time and is decided depending on whether an output obtained by multiplying the rated output by a specific coefficient is equal to or smaller than a reference value.
4. The audio amplifier usually has a high SVRR (an in-phase voltage removing ratio). For this reason, there is no problem if a ripple included in the output of a power supply for the audio amplifier is within a limit.

Accordingly, a power device designed to satisfy each of the contents is used for the conventional audio amplifier.

However, there are the following problems in the design of the conventional audio amplifier. More specifically, in the case in which a power device comprising a low frequency power transformer is used, there is a problem in that many restrictions are imposed in respect of a design when a low frequency power transformer is used as a small-sized integral type power supply for a multichannel audio amplifier because the volume of each low frequency power transformer is large. When a low frequency power transformer having a small size is used in order to eliminate the restrictions in respect of the design, moreover, a load regulation is deteriorated. For this reason, it is necessary to cause the breakdown voltage of a capacitor to be higher. Furthermore, the low frequency power transformer is an a stable power supply and is influenced by a line regulation and a load regulation. For this reason, it is necessary to cause the breakdown voltage of a capacitor having a large capacity on a secondary side to be higher. In addition, when the copper loss of the low frequency power transformer is decreased to enhance the load regulation, there is a problem in that a power factor and a power harmonic are deteriorated. When a power device comprising a low frequency power transformer is used as a power supply for a multichannel audio amplifier which can reproduce a surround voice, moreover, it is impossible to obtain a value by adding an output in the driving operation of only one channel corresponding to all channels in a full-channel simultaneous output due to a load regulation characteristic, and there is a property that an output voltage is reduced in proportion to an output current. There is a problem in that this property is hard to control optionally.

On the other hand, in the case in which a switching power device is to be used, a high frequency power transformer has a small copper loss. For this reason, a power harmonic is easily generated and a rush current is increased. Therefore, it is necessary to take countermeasures against the power harmonic and measures for preventing the rush current. Moreover, the switching power device has an excellent load regulation at a constant voltage output and an output power is increased in proportion to a load current. For this reason, when a switching power device is used as a small-sized integral type power supply for a multichannel audio amplifier, a value is obtained by adding the output in the driving operation of only one channel corresponding to all of the channels in the full-channel simultaneous output. Consequently, the output of an amplifier becomes excessive. If there is such a property, moreover, a temperature test for the audio amplifier is carried out at a large output. Therefore, tough conditions are set.

Although an output is practically carried out instantly for each channel in the audio amplifier, however, all of the channels are rarely driven at the same time. If the total output of the audio amplifier in the full-channel simultaneous output has the value obtained by adding outputs in the driving operation of only one channel corresponding to all of the channels as described above, however, there is no advantage to a user and the temperature test becomes uselessly strict. It is preferable to positively restrict the output in the full-channel simultaneous driving operation in the same manner as in the case in which a power device comprising a low frequency power transformer is used.

SUMMARY OF THE INVENTION

Therefore, it is an object of the invention to provide a power device for an audio amplifier which is used for the audio amplifier, eliminates the respective drawbacks of a low frequency power transformer and a switching power supply and has both advantages.

The invention has the following structures as means for solving the problems.

(1) The invention is characterized by a rectifier circuit for rectifying an input AC voltage;

a non-capacitor flyback converter circuit for switching an input voltage applied to a primary winding of a transformer by a switching element without carrying out smoothing after executing a rectification by the rectifier circuit and for rectifying, smoothing and outputting a switching voltage induced to a secondary winding of the transformer by a rectifier element and a capacitor;

a negative feedback circuit for feeding back a fluctuation in an output current to be supplied to a load to the non-capacitor flyback converter circuit at a lower speed than an input AC frequency; and a voltage control circuit for dropping an output voltage to be applied from the non-capacitor flyback converter circuit to the load with an increase in an output current and for changing a reduction rate stepwise with the increase in the output current.

With this structure, the non-capacitor flyback converter circuit does not comprise a smoothing input capacitor having a large capacity. Therefore, the generation of a higher harmonic can be suppressed and a rush current preventing element is not required. Moreover, a high frequency power transformer taking a smaller size than the size of a lower frequency power transformer is used as a transformer. Consequently, it is possible to reduce the size and weight of the device. Furthermore, the negative feedback circuit feeds back a fluctuation in the output current to be supplied to the load to the converter circuit at the lower speed than the input AC frequency. By regulating the feedback speed of the negative feedback circuit, accordingly, it is possible to cause an input AC current to be in-phase with an input AC voltage, thereby making the input AC current proportional to the input AC voltage. Consequently, it is possible to improve a power factor. Furthermore, the voltage control circuit drops the output voltage to be applied to the load with the increase in the output current to be supplied to the load. A reduction rate is changed stepwise with the increase in the output current. Therefore, it is possible to use a capacitor having a low breakdown voltage to some degree which smoothes the switching voltage induced to the secondary winding by setting the output voltage to be a constant voltage even if the output current is increased in a light load. Moreover, it is also possible to carry out setting to have the same output characteristic as that in a power device comprising a low frequency power transformer.

It is assumed that the reduction rate of the output voltage also includes the case in which a reduction rate is 0%, that is, the output voltage is maintained to be constant even if the output current is increased.

(2) The voltage control circuit comprises:

a constant voltage control circuit including a first shunt regulator having a reference voltage Vref1 and two resistors R1 and R2 for dividing and applying the output voltage to a reference of the first shunt regulator; and a voltage variable control circuit including a second shunt regulator having a reference voltage Vref2, two resistors R3 and R4 for dividing and applying an output voltage to a reference of the second shunt regulator, and a load current detecting resistor Rs connected in series to a load and serving to detect the load current between an anode of the second shunt regulator and the resistor R4, the negative feedback circuit includes a first capacitor connected between a cathode of the first shunt regulator and the reference and a second capacitor connected between a cathode of the second shunt regulator and the reference, the constant voltage control circuit is connected to a latter stage of the voltage variable control circuit, and each of constants of the constant voltage control circuit and the voltage variable control circuit is set as follows:

$$V\text{ref}2\times(1+R3/R4)>V\text{ref}1\times(1+R1/R2).$$

With this structure, the constant of each of the elements constituting the constant voltage control circuit and the voltage variable control circuit is set to be Vref2×(1+R3/R4)>Vref1×(1+R1/R2). When the output current to be supplied to the load is equal to or smaller than a threshold, therefore, the output voltage to be applied to the load can be controlled to be a constant voltage by the constant voltage control circuit. Moreover, the load current detecting resistor Rs is connected between the anode of the second shunt regulator and the resistor R4. When the output current to be supplied to the load exceeds the threshold, therefore, the output voltage to be applied to the load can be reduced in proportion to the output current by the voltage variable control circuit.

Moreover, the first capacitor is connected between the cathode of the first shunt regulator and the reference, and the second capacitor is connected between the cathode of the second shunt regulator and the reference. Therefore, by setting the capacities of both of the capacitors to be several μF to several tens μF, for example, it is possible to feed back a fluctuation in the output current to be supplied to the load to the converter circuit at a much lower speed than the input AC frequency and to cause the input AC current to be proportional to the input AC voltage, thereby improving a power factor.

(3) The constant voltage control circuit and the voltage variable control circuit include a transistor in place of the first shunt regulator or the second shunt regulator.

With this structure, it is possible to constitute the voltage variable control circuit by using a transistor in place of the shunt regulator. By using a transistor which is more inexpensive than the shunt regulator, accordingly, it is possible to constitute the power device inexpensively.

(4) The constant voltage control circuit further includes a load current detecting resistor Rs' connected in series to a load and serving to detect the load current between an anode of the first shunt regulator and the resistor R2.

With this structure, it is possible to drop the output voltage of the constant voltage control circuit in proportion to the load current by providing the load current detecting resistor in the constant voltage control circuit. By setting the output voltage to be dropped with a different inclination from the inclination of the voltage variable control circuit, therefore, it is possible to constitute the power device in which the reduction rate of the output voltage is changed in two stages in proportion to the increase in the output current.

(5) The switching power device further comprises a second voltage variable control circuit including a third shunt regulator having a reference voltage Vref3, two resistors R5 and R6 for dividing and applying the output voltage to a reference of the third shunt regulator, and a load current detecting resistor Rs" connected in series to a load and serving to detect the load current between an anode of the third shunt regulator and the resistor R6, the negative feedback circuit includes a third capacitor connected between a cathode of the third shunt regulator and the reference, the second voltage variable control circuit is connected to a former stage of the voltage variable control circuit, and each of constants of the second voltage variable control circuit and the voltage variable control circuit is set as follows:

$$V\text{ref}3\times(1+R5/R6)>V\text{ref}2\times(1+R3/R4).$$

With this structure, it is possible to constitute the power device in such a manner that the second voltage variable control circuit is connected to the former stage of the voltage variable control circuit to set the output voltage of the second voltage variable control circuit to be dropped with a different inclination from the inclination of the voltage variable control circuit, and the reduction rate of the output voltage is thus changed in two stages in proportion to the increase in the output current at a constant output voltage until the output current reaches a threshold in proportion to the output current.

(6) The voltage control circuit comprises:

a constant voltage control circuit including a first shunt regulator having a reference voltage Vref1 and two resistors R1 and R2 for dividing and applying the output voltage to a reference of the first shunt regulator; and a voltage variable control circuit including a second shunt regulator having a reference voltage Vref2, two resistors R3 and R4 for dividing and applying an output voltage to a reference of the second shunt regulator, and a load current detecting resistor Rs connected in series to a load and serving to detect the load current between an anode of the second shunt regulator and the resistor R4, the negative feedback circuit includes a first capacitor connected between a cathode of the first shunt regulator and the reference and a second capacitor connected between a cathode of the second shunt regulator and the reference, the constant voltage control circuit is connected to a former stage of the voltage variable control circuit, and each of constants of the constant voltage control circuit and the voltage variable control circuit is set as follows:

$$V\text{ref}2\times(1+R3/R4)>V\text{ref}1\times(1+R1/R2).$$

With this structure, the constant of each of the elements constituting the constant voltage control circuit and the voltage variable control circuit is set to be Vref2×(1+R3/R4)>Vref1×(1+R1/R2), and the load current detecting resistor Rs is connected between the anode of the second shunt regulator and the resistor R4. When the output current to be supplied to the load is equal to or smaller than the threshold, therefore, it is possible to drop the output voltage to be applied to the load with the increase in the output current by the constant voltage control circuit. Moreover, the load current detecting resistor Rs is connected between the anode of the second shunt regulator and the resistor R4. When the output current to be supplied to the load exceeds the threshold, therefore, it is possible to drop the output voltage to be applied to the load further suddenly with the increase in the output current by the voltage variable control circuit.

Moreover, the first capacitor is connected between the cathode of the first shunt regulator and the reference and the second capacitor is connected between the cathode of the second shunt regulator and the reference. Therefore, by setting the capacities of both of the capacitors to be several μF to several tens μF, for example, it is possible to feed back a fluctuation in the output current to be supplied to the load to the converter circuit at a much lower speed than the input AC frequency and to cause the input AC current to be proportional to the input AC voltage, thereby improving a power factor.

The switching power device according to the invention uses the non-capacitor flyback converter circuit in which a smoothing input capacitor having a large capacity is not provided. Therefore, the generation of a higher harmonic can be suppressed and a rush current preventing element is not required. Moreover, a high frequency power transformer taking a smaller size than the size of a lower frequency power transformer is used as a transformer. Consequently, it is possible to reduce the size and weight of the device. Furthermore, the negative feedback circuit feeds back a fluctuation in the output current to be supplied to the load to the converter circuit at a lower speed than the input AC frequency. By regulating the feedback speed of the negative feedback circuit, therefore, it is possible to cause the input AC current to be in-phase with the input AC voltage, thereby making the input AC current proportional to the input AC voltage. Consequently, it is possible to improve a power factor. Furthermore, the voltage control circuit controls the output voltage to be applied to the load so as to be a constant voltage and the output voltage is dropped in proportion to the output current to be supplied to the load when the output current exceeds the threshold. Therefore, it is possible to use a capacitor having a low breakdown voltage to some degree which smoothes a switching voltage induced to a secondary winding, and furthermore, to have the same output characteristic as that in the power device comprising the low frequency power transformer.

DETAILED DESCRIPTION OF PREFERRED EMBODIMENTS

Figure 1:
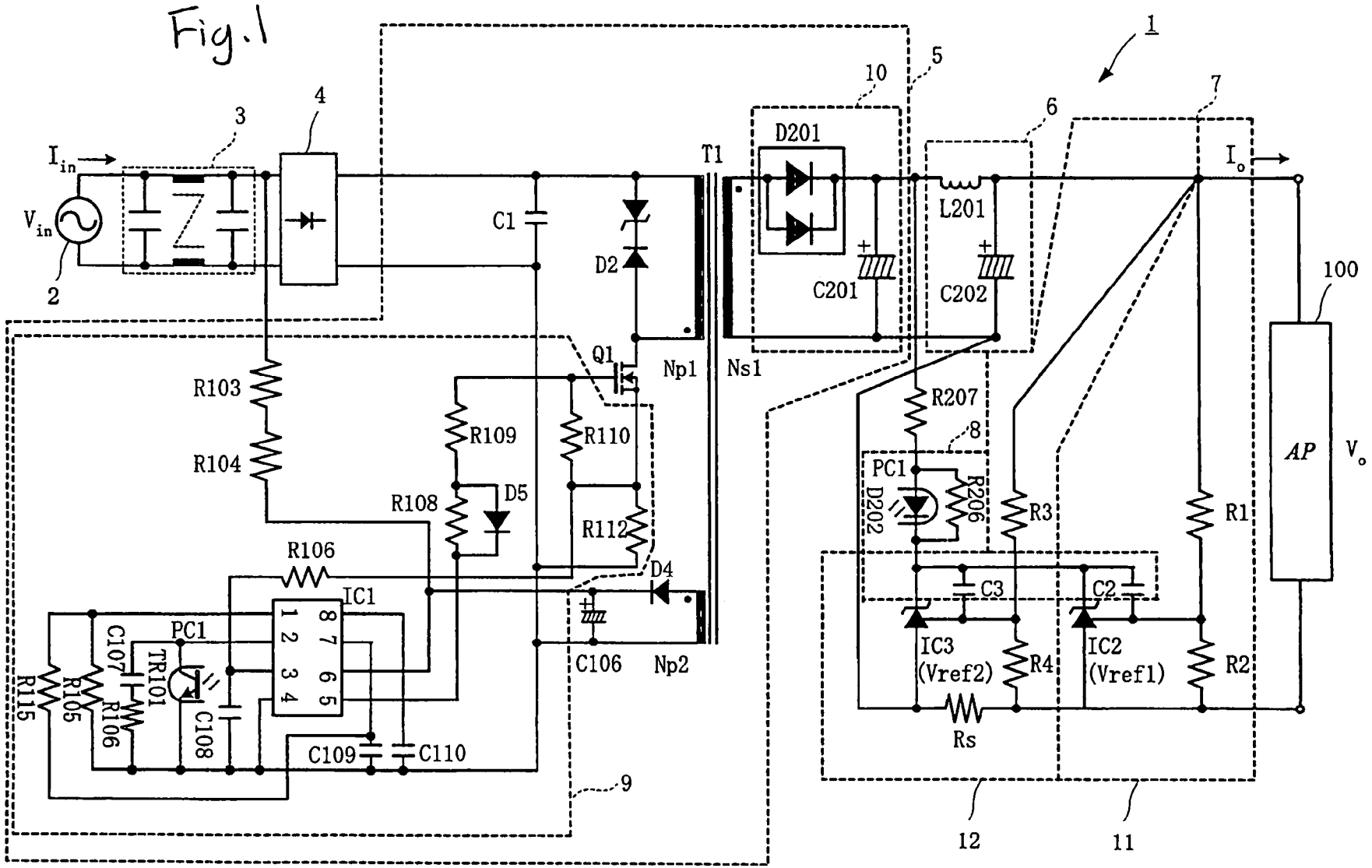
FIG. 1 is a circuit diagram showing the structure of a switching power device according to an embodiment of the invention.
Figure 2:
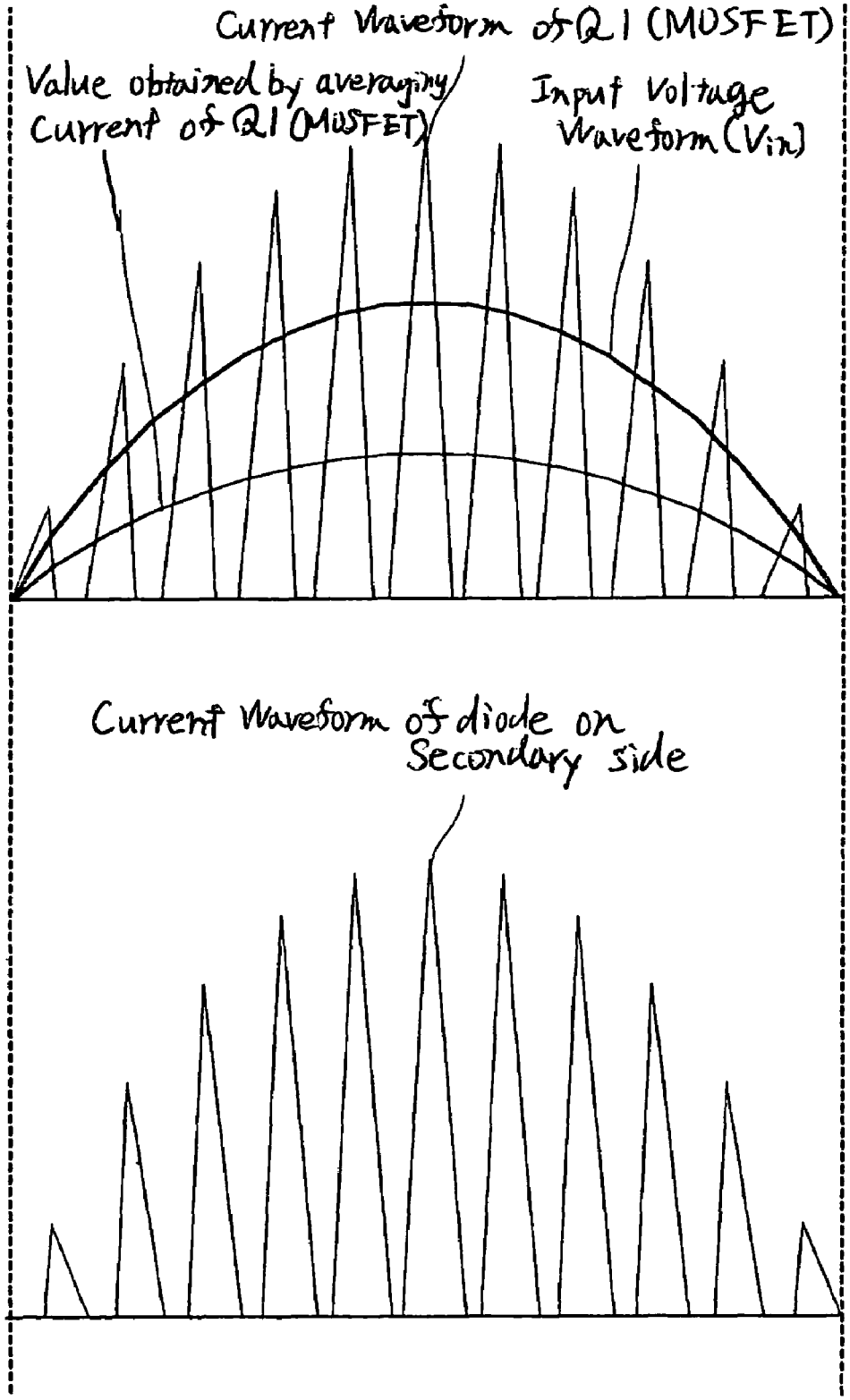
FIG. 2 is a waveform diagram showing an input voltage, an input current and an output current in the flyback transformer of the switching power device.

An embodiment of a switching power device according to the invention will be described below in detail. FIG. 1 is a circuit diagram showing the structure of the switching power device according to the embodiment of the invention. FIG. 2 is a waveform diagram showing an input voltage, an input current and an output current in the flyback transformer of the switching power device. In the following description, a switching power device 1 according to the invention is applied to a power circuit for an audio amplifier. For the audio amplifier, it is suitable to use an analog amplifier having a high SVRR and a digital audio amplifier of a feedback type.

The switching power device 1 is connected to a commercial AC power supply 2 and comprises a noise filter 3, a rectifier circuit 4, an input non-capacitor flyback converter (hereinafter referred to as a non-capacitor converter) 5, a noise filter 6, a voltage control circuit 7 and a negative feedback circuit 8.

The noise filter 3 includes a plurality of capacitors and coils and serves to remove a common mode noise and a normal mode noise.

The rectifier circuit 4 is constituted by a bridge diode and full-wave rectifies and outputs an input AC voltage.

The non-capacitor converter circuit 5 includes a capacitor C1, a flyback transformer T1, a switching element Q1, a PWM control circuit 9, and a smoothing rectifier circuit 10. The capacitor C1 is provided for removing a noise and has a capacity of approximately several μF. The flyback transformer T1 has a primary winding Np1, a secondary winding Ns1 having a reverse polarity to the polarity of the primary winding, and an auxiliary winding Np2 having a reverse polarity to the polarity of the primary winding. The switching element Q1 is a MOSFET and serves to switch an input voltage applied to the primary winding Np1 of the flyback transformer T1. The PWM control circuit 9 is operated at a power induced to the auxiliary winding Np2 and controls the switching operation of the switching element Q1, thereby carrying out a PWM control. The smoothing rectifier circuit 10 rectifies, smoothes and outputs a switching voltage induced to the secondary winding Ns1 of the flyback transformer T1 by a rectifier element D201 and a capacitor C201 having a large capacity.

FIG. 1 shows an example in which FA3641 to be a PWM control IC manufactured by Fuji Electric Co., Ltd. is used for the PWM control IC (IC1) of the PWM control circuit 9, and there will be omitted the description of a plurality of resistors and capacitors for setting and controlling an operation which are provided in the PWM control circuit 9.

The non-capacitor converter circuit 5 is a converter of such a type as to store a power in the flyback transformer T1 for a period in which the switching element Q1 is ON and to supply the power stored in the flyback transformer T1 to a load 100 for a period in which the switching element Q1 is OFF. Moreover, the non-capacitor converter circuit 5 includes an input capacitor having a large capacity which serves to smooth an input AC voltage, and exactly applies, to the flyback transformer T1, the input AC voltage which is full-wave rectified by the rectifier circuit 4. The PWM control circuit 9 controls the switching element Q1 and (intermittently) switches a current input to the primary winding Np1 of the flyback transformer T1, thereby carrying out a PWM control in a current discontinuous mode to rectify, smooth and output a switching voltage induced to the secondary winding Ns1 of the flyback transformer T1 by the smoothing rectifier circuit 10. While an AC ripple is superposed on the output of the non-capacitor converter circuit 5, there is no problem if the AC ripple is present within a predetermined range in the case in which the load 100 is an audio amplifier.

The noise filter 6 is constituted by a coil L201 and a capacitor C202, and removes a spike noise.

The voltage control circuit 7 is constituted by a constant voltage control circuit 11 and a voltage variable control circuit 12, and the constant voltage control circuit 11 is connected to the latter stage of the voltage variable control circuit 12. The constant voltage control circuit 11 includes a shunt regulator IC2 having a reference voltage Vref1 and two resistors R1 and R2 for dividing and applying an output voltage Vo to the reference of the shunt regulator IC2. The voltage variable control circuit 12 includes a shunt regulator IC3 having a reference voltage Vref2, two resistors R3 and R4 for dividing and applying the output voltage Vo to the reference of the shunt regulator IC3, and a load current detecting resistor Rs connected in series to the load 100 and serving to detect the load current between the anode of the shunt regulator IC3 and the resistor R4. The voltage control circuit 7 drops a voltage output from the non-capacitor converter circuit 5 and controls the output voltage Vo to be applied to the load 100 so as to be a constant voltage, and drops the output voltage Vo in proportion to an output current Io to be supplied to the load 100 when the output current Io exceeds a threshold.

The negative feedback circuit 8 includes a photo coupler PC1, a capacitor C2 connected between the cathode of the shunt regulator IC2 and the reference, and a capacitor C3 connected between the cathode of the shunt regulator IC3 and the reference. In the photo coupler PC1, a light emitting diode D202 is connected to the shunt regulator IC2 of the constant voltage control circuit 11 and the shunt regulator IC3 of the voltage variable control circuit 12, and a phototransistor Tr101 is connected to the IC1 of the PWM control circuit 9. Moreover, the capacitor C2 is connected between the cathode of the shunt regulator IC2 and the reference, and the capacitor C3 is connected between the cathode of the shunt regulator IC3 and the reference. Both of the capacities of the capacitor C2 and the capacitor C3 are set to be several μF to several tens μF. The negative feedback circuit 8 feeds back, to the non-capacitor converter circuit 5, a fluctuation in the output current to be supplied to the load 100 at a lower speed than an input AC frequency.

The switching power device 1 is connected to the commercial AC power supply 2 for use, and the noise of an input alternating current is removed through the noise filter 3 and the input alternating current is then full-wave rectified by the rectifier circuit 4 and passes through the input non-capacitor flyback converter (hereinafter referred to as a non-capacitor converter) 5, and is smoothed and rectified by the smoothing rectifier circuit 10 and a noise is removed by the noise filter 6. Thereafter, a voltage is regulated by the voltage control circuit 7 and a DC output is supplied to the load 100.

In the switching power device 1 according to the invention, as described above,

1. A capacitor having a large capacity for smoothing an input AC voltage is not provided.

2. A PWM control is carried out in a current discontinuous mode in the non-capacitor converter circuit 5.

3. The capacitors C2 and C3 are connected between the cathode of the shunt regulator IC2 and the reference and between the cathode of the shunt regulator IC3 and the reference to cause the response of the negative feedback circuit 8 to have such a property as to be sufficiently delayed from an input AC frequency.

As shown in FIG. 2, therefore, an input AC current Iac can be set to be in-phase with an input AC voltage Vac to cause the input AC current Iac to be proportional to the input AC voltage Vac.

Thus, the switching power device 1 according to the invention uses the non-capacitor converter circuit 5 which is not provided with the smoothing input capacitor having a large capacity. Therefore, the generation of a higher harmonic can be suppressed and a rush current preventing element is not required. Moreover, the high frequency power transformer (the flyback transformer T1) having a smaller size than the size of a low frequency power transformer is used as the transformer. Consequently, it is possible to reduce the size and weight of the device. Furthermore, the negative feedback circuit 8 feeds back a fluctuation in an output current to be supplied to a load to the non-capacitor converter circuit 5 at a lower speed than the input AC frequency. By regulating the feedback speed of the negative feedback circuit, therefore, it is possible to cause the input AC current to be in-phase with the input AC voltage, thereby making the input AC current Iac proportional to the input AC voltage Vac. Consequently, it is possible to improve a power factor.

In the switching power device 1 according to the invention, next, the light emitting diode D202 of the photo coupler PC1 of the negative feedback circuit 8 is connected to the shunt regulator IC2 of the constant voltage control circuit 11 as described above, and the output voltage of the constant voltage control circuit 11 is fed back to the PWM control circuit 9 by the photo coupler PC1 even if it fluctuates. Therefore, the PWM control circuit 9 can carry out a PWM control, thereby stabilizing the output voltage Vo to be a constant voltage. The output voltage of the constant voltage control circuit 11 is determined by the reference voltage Vref1 of the shunt regulator IC2 and the two resistors R1 and R2 for dividing and applying the output voltage Vo to the reference of the shunt regulator IC2 and is expressed as Vo=Vref1×(1+R1/R2).

Moreover, the light emitting diode D202 of the photo coupler PC1 of the negative feedback circuit 8 is connected to the shunt regulator IC3 of the voltage variable control circuit 12. Therefore, the output voltage of the voltage variable control circuit 12 is fed back to the PWM control circuit 9 by the photo coupler PC1 even if it fluctuates. The output voltage of the voltage variable control circuit 12 is determined by the reference voltage Vref2 of the shunt regulator IC3, the two resistors R3 and R4 for dividing and applying the output voltage Vo to the reference of the shunt regulator IC3, the load current detecting resistor Rs and the output current Io, and is expressed as Vo=(Vref2−Io×Rs)×(1+R3/R4). In other words, when the output current Io is increased, the output voltage Vo is decreased proportionally.

Figure 3:
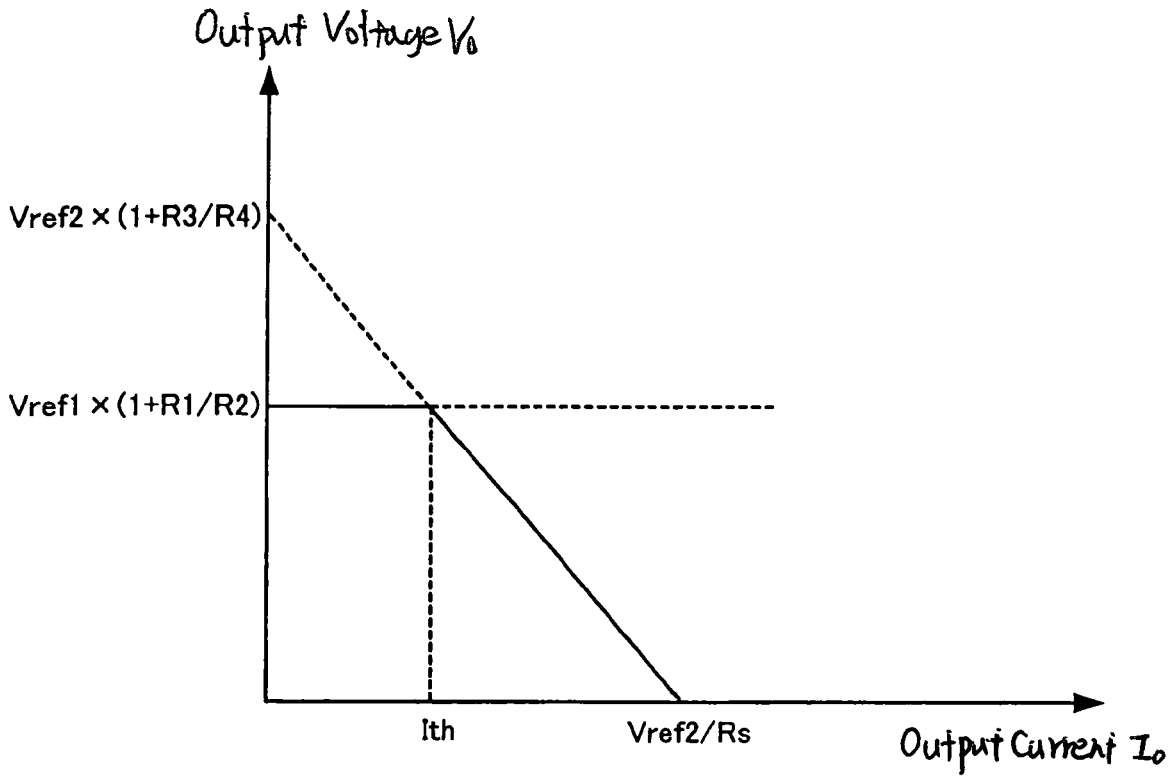
FIG. 3 is a graph showing a relationship between an output current Io and an output voltage Vo in a switching power device 1 illustrated in FIG. 1.

FIG. 3 is a graph showing a relationship between the output current Io and the output voltage Vo in the switching power device 1 illustrated in FIG. 1. Each of the constants of the reference voltage Vref1 of the shunt regulator IC2 of the constant voltage control circuit 11, the resistors R1 and R2, the reference voltage Vref2 of the shunt regulator IC3 of the voltage variable control circuit 12 and the resistors R3 and R4 is set to obtain the following expression.

$$V\mathrm{ref2}\times(1+R3/R4)>V\mathrm{ref1}\times(1+R1/R2)$$

As shown in FIG. 3, consequently, there is acquired a characteristic within a range in which an output current is 0≦Io≦Vref2/Rs. More specifically, a constant voltage Vo=Vref1×(1+R1/R2) is obtained when the output current Io is equal to or smaller than a threshold current Ith, and the output voltage Vo is decreased in proportion to an increase in the output current Io when the output current Io exceeds the threshold current Ith.

The threshold current Ith represents a current on an intersecting point of Vo=Vref1×(1+R1/R2) and Vo=(Vref2−Io×Rs)×(1+R3/R4).

Referring to a line regulation, accordingly, there is a constant voltage characteristic. Therefore, it is possible to use the capacitor C201 for smoothing a switching voltage induced to a secondary winding which has a low breakdown voltage to some degree. Moreover, the output current of the power device is set to be a region 1 having a constant voltage at time of the 1 to 2 channel outputs of the audio amplifier, and the output current of the power device is set to be a region 2 in which a voltage is decreased in proportion to an increase in a current at time of the full-channel output of a multichannel. Consequently, it is possible to obtain the same output characteristic as that of a power device including a low frequency power transformer.

In the voltage control circuit 7 shown in FIG. 1, there is employed a structure in which the constant voltage control circuit 11 is connected to the latter stage of the voltage variable control circuit 12. Consequently, it is possible to obtain a characteristic in which the output current Io has a constant voltage of Vo=Vref1×(1+R1/R2) with a threshold current Ith or less as shown in FIG. 3.

Figure 4:
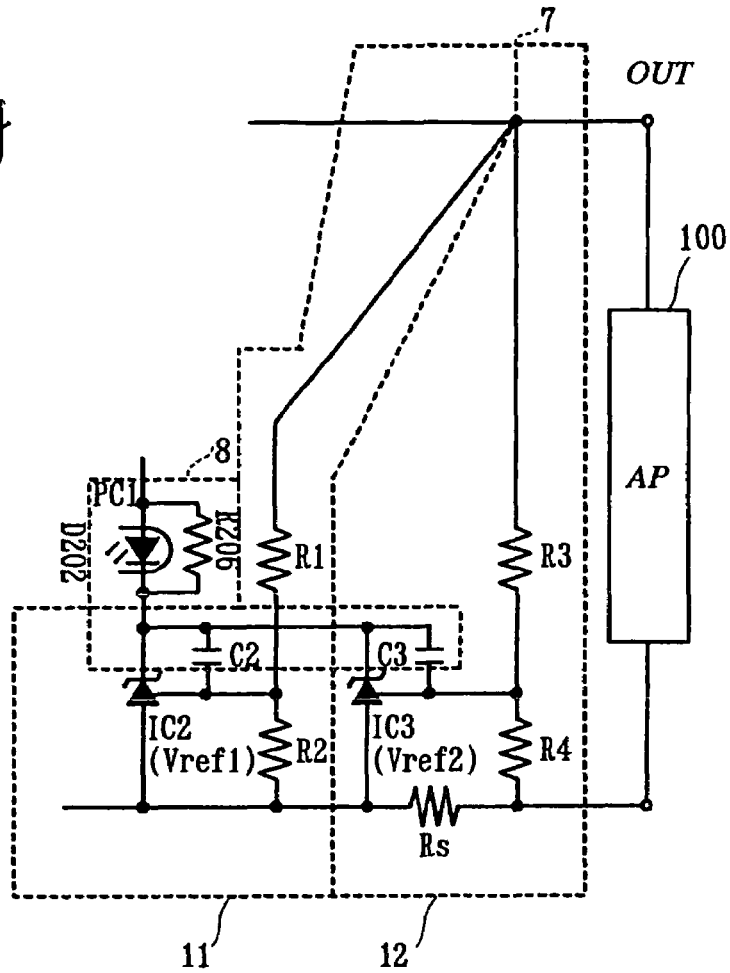
FIG. 4 is a diagram showing a variant of a voltage variable control circuit and a graph showing a relationship between the output current Io and the output voltage Vo in the switching power device 1 applying the circuit.
Figure 4:
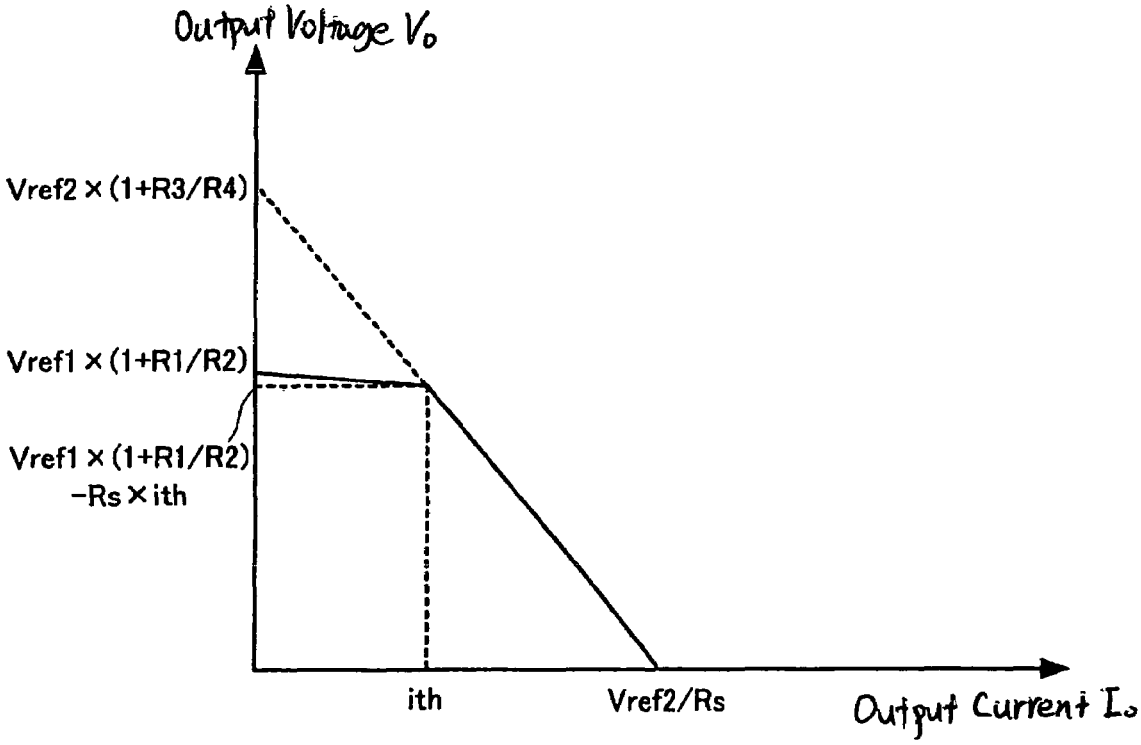

FIG. 4 is a diagram showing a variant of the voltage variable control circuit and a graph showing a relationship between an output current Io and an output voltage Vo in the switching power device 1 applying the circuit. On the other hand, with such a structure that the constant voltage control circuit 11 is connected to the former stage of the voltage variable control circuit 12, there is obtained a characteristic in which the output current Io does not have a constant voltage with the threshold current Ith or less by the influence of the load current detecting resistor Rs but the output voltage Vo is slowly decreased in proportion to an increase in the output current Io. More specifically, as shown in FIG. 4(A), there is employed a structure in which the constant voltage control circuit 11 is connected to the former stage of the voltage variable control circuit 12 in the switching power device 1. Moreover, the constant of each of the components of the constant voltage control circuit 11 and the voltage variable control circuit 12 is set to obtain the following expression.

$$V\mathrm{ref1}\times(1+R3/R4)>V\mathrm{ref1}\times(1+R1/R2)$$

Consequently, there is acquired a characteristic within a range in which an output current is 0≦Io≦Vref2/Rs. More specifically, the output voltage Vo is dropped at a reduction rate Rs in proportion to the increase in the output current Io and the output voltage Vo=Vref1×(1+R1/R2)−Rs×Io is obtained when the output current Io is equal to or smaller than a threshold current ith. When the output current Io exceeds the threshold current ith, moreover, the output voltage Vo is dropped at a reduction rate of Rs×(1+R3/R4) in proportion to the increase in the output current Io.

Accordingly, the foregoing is suitable for the case in which the reduction rate of a current is to be changed in two stages in proportion to the increase in the output current Io.

The threshold current ith represents a current on an intersecting point of Vo=Vref1×(1+R1/R2)−Rs×Io and Vo=(Vref2−Io×Rs)×(1+R3/R4). Moreover, the current detecting resistor Rs having a resistance value of approximately 10 mΩ is usually used. Therefore, the reduction rate of the output voltage Vo with the threshold current ith or less is very low.

Figure 5:
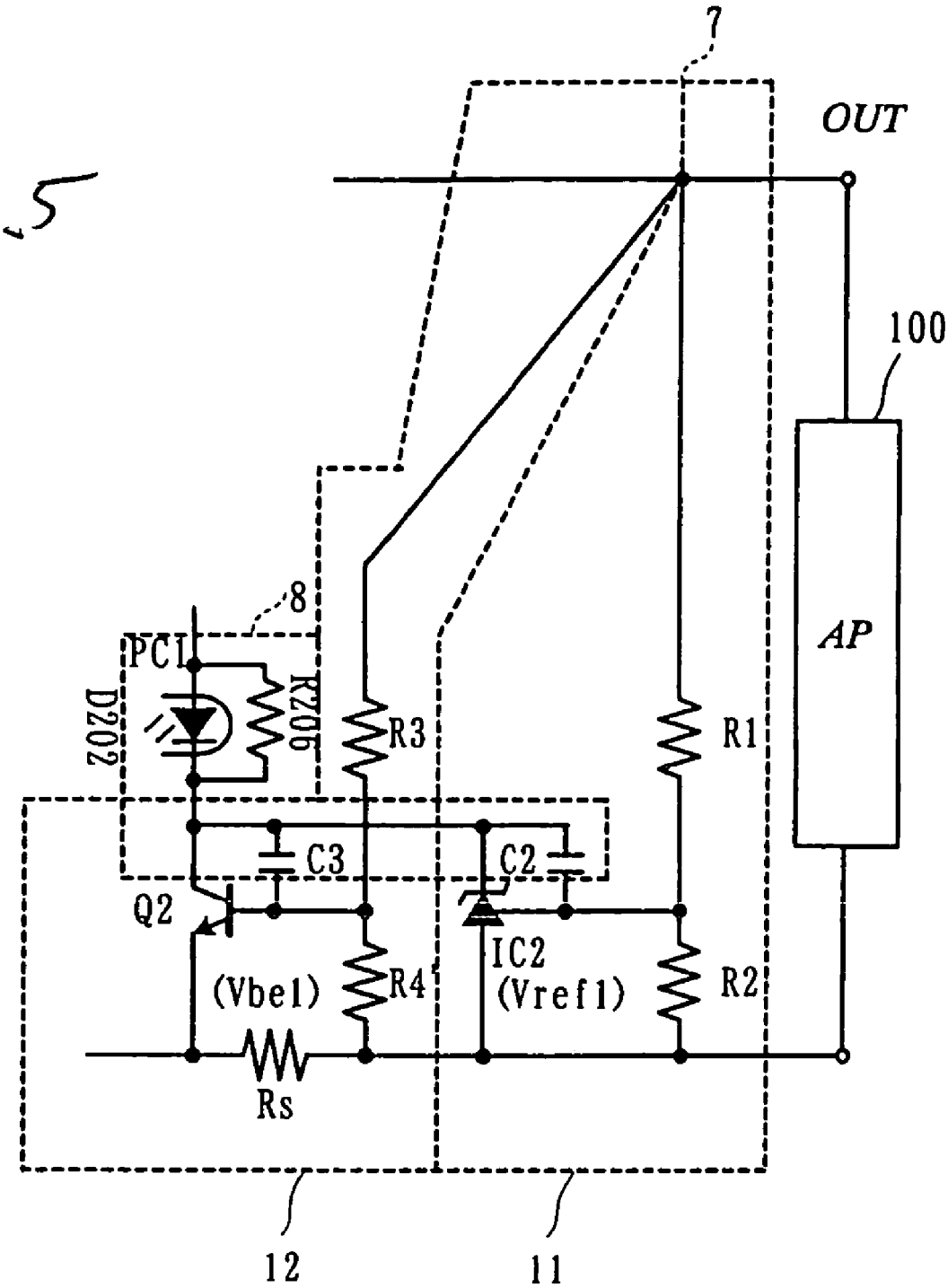
FIG. 5 is a circuit diagram showing the case in which a transistor is used for the voltage variable control circuit.

FIG. 5 is a circuit diagram showing the case in which a transistor is used in a voltage variable control circuit. As shown in FIG. 5, a transistor Q2 can be used in place of the IC3 of the voltage variable control circuit 12 shown in FIG. 1. In this case, the output voltage of the voltage variable control circuit 12 is determined by a base—emitter voltage Vbel of the transistor Q2, two resistors R3' and R4' for dividing and applying the output voltage Vo to the base of the transistor Q2, a load current detecting resistor Rs and the output current Io, and Vo=(Vbel−Io×Rs)×(1+R3'/R4') is obtained. In other words, the output voltage Vo is decreased in proportion to the increase in the output current Io.

Moreover, each of the constants of the reference voltage Vref1 of the shunt regulator IC2 of the constant voltage control circuit 11, the resistors R1 and R2, the base—emitter voltage Vbel of the transistor Q2 of the voltage variable control circuit 12 and the resistors R3 and R4 is set to obtain the following expression.

$$V\mathrm{bel}\times(1+R3'/R4')>V\mathrm{ref1}\times(1+R1/R2)$$

In the same manner as in the graph shown in FIG. 2, there is acquired a characteristic within a range in which an output current is 0≦Io≦Vref2/Rs. More specifically, a constant voltage Vo=Vref1×(1+R1/R2) is obtained when the output current Io is equal to or smaller than a threshold current Ith', and the output voltage Vo is decreased in proportion to the increase in the output current Io when the output current Io exceeds the threshold current Ith'.

The threshold current Ith' represents a current on an intersecting point of Vo=Vref1×(1+R1/R2) and Vo=(Vbel−Io×Rs)×(1+R3'/R4').

By using a transistor which is more inexpensive than the shunt regulator, accordingly, it is possible to constitute the power device inexpensively.

Also in the constant voltage control circuit 11, it is also possible to replace the shunt regulator with the transistor. In both the constant voltage control circuit 11 and the voltage variable control circuit 12, moreover, it is also possible to replace the shunt regulator with the transistor. In this case, the power device can be constituted more inexpensively.

Figure 6:
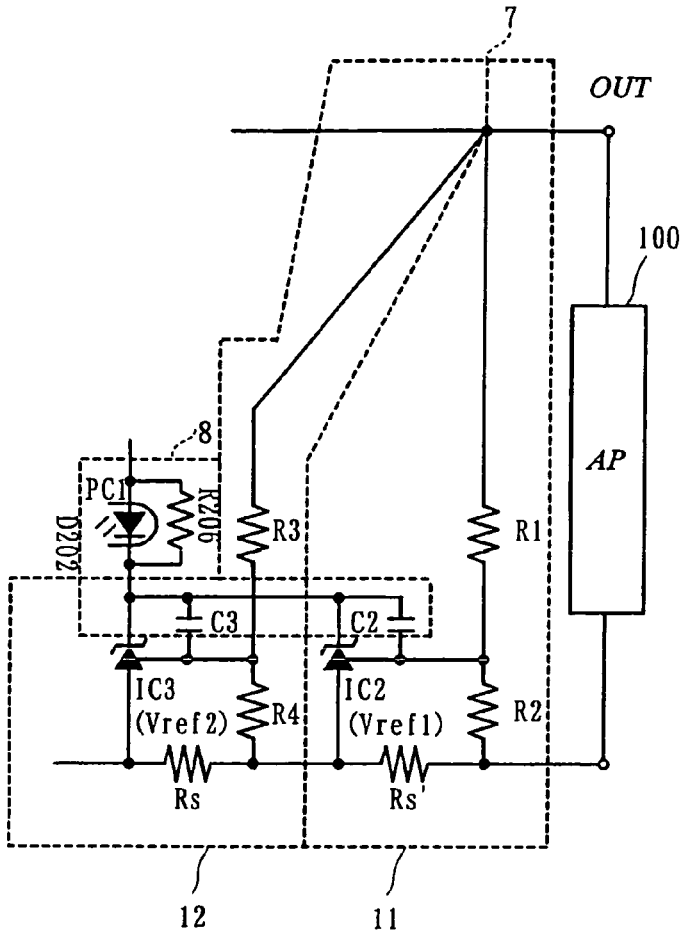
FIG. 6 is a circuit diagram showing a structure in which a current detecting resistor is added to a constant voltage control circuit.
Figure 7:
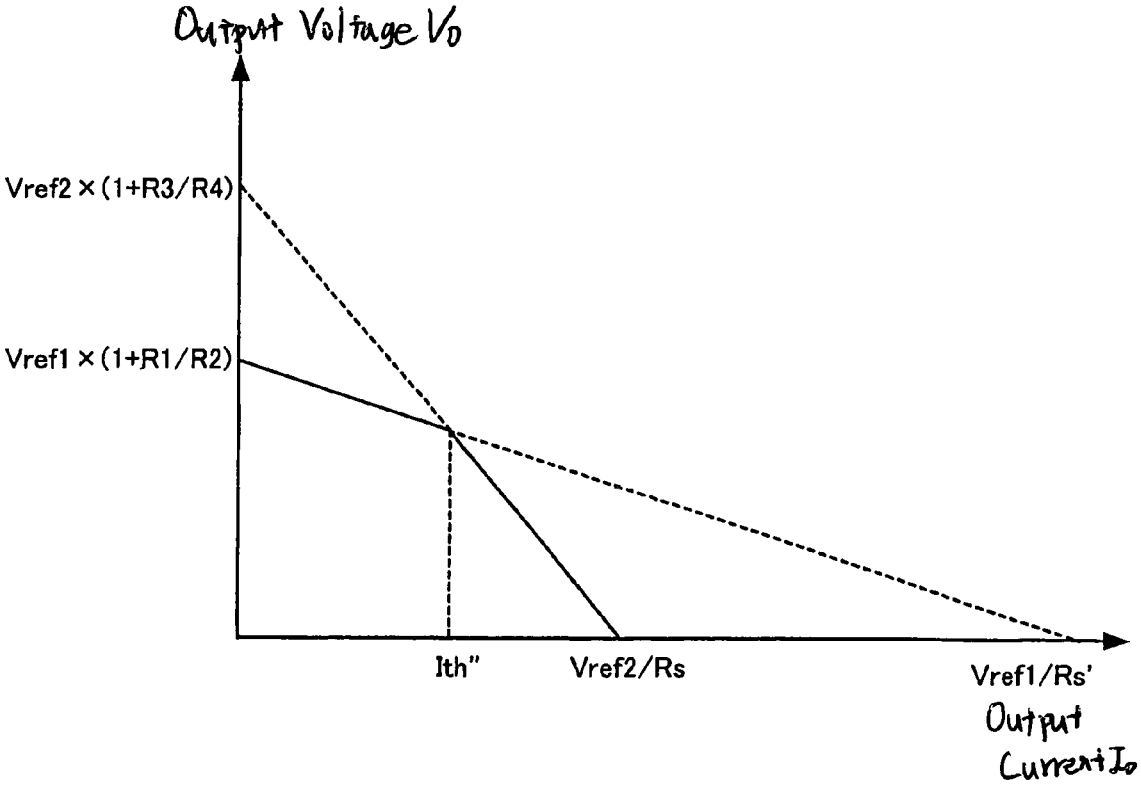
FIG. 7 is a graph showing a relationship between an output current Io and an output voltage Vo in the voltage control circuit illustrated in FIG. 6.

FIG. 6 is a circuit diagram showing a structure in which a load current detecting resistor is added to a constant voltage control circuit. FIG. 7 is a graph showing a relationship between an output current Io and an output voltage Vo in the voltage control circuit illustrated in FIG. 6. As shown in FIG. 6, a load current detecting resistor Rs' for detecting a load current is connected in series to the load 100 between the anode of the shunt regulator IC2 of the constant voltage control circuit 11 and the resistor R2. Even if the output voltage Vo of the constant voltage control circuit 11 is equal to or lower than a threshold current Ith", consequently, the output voltage Vo can be decreased in proportion to an increase in the output current Io. More specifically, the load current detecting resistor Rs' is provided so that the output voltage Vo of the constant voltage control circuit 11 is obtained as Vo=(Vref1−Io×Rs')×(1+R1/R2). Each of the constants of a reference voltage Vref1 of the shunt regulator IC2 of the constant voltage control circuit 11, the resistors R1 and R2, a reference voltage Vref2 of the shunt regulator IC3 of the voltage variable control circuit 12, and the resistors R3 and R4 is set to obtain the following expression.

$$V\mathrm{ref}2\times(1+R3/R4)>V\mathrm{ref}1\times(1+R1/R2)$$

As shown in FIG. 7, consequently, there is acquired a characteristic within a range in which an output current is 0≦Io≦Vref2/Rs. More specifically, the output voltage Vo is decreased based on an equation of Vo=(Vref1−Io×Rs')×(1+R1/R2) in proportion to an increase in the output current Io when the output current Io is equal to or smaller than the threshold current Ith", and the output voltage Vo is decreased based on an equation of Vo=(Vref2−Io×Rs)×(1+R3/R4) in proportion to the increase in the output current Io when the output current Io exceeds the threshold current Ith".

Accordingly, the foregoing is suitable for the case in which the reduction rate of a current is to be changed in two stages in proportion to the increase in the output current Io.

The threshold current Ith" represents a current on an intersecting point of Vo=(Vref1−Io×Rs')×(1+R1/R2) and Vo=(Vref2−Io×Rs')×(1+R3/R4).

Figure 8:
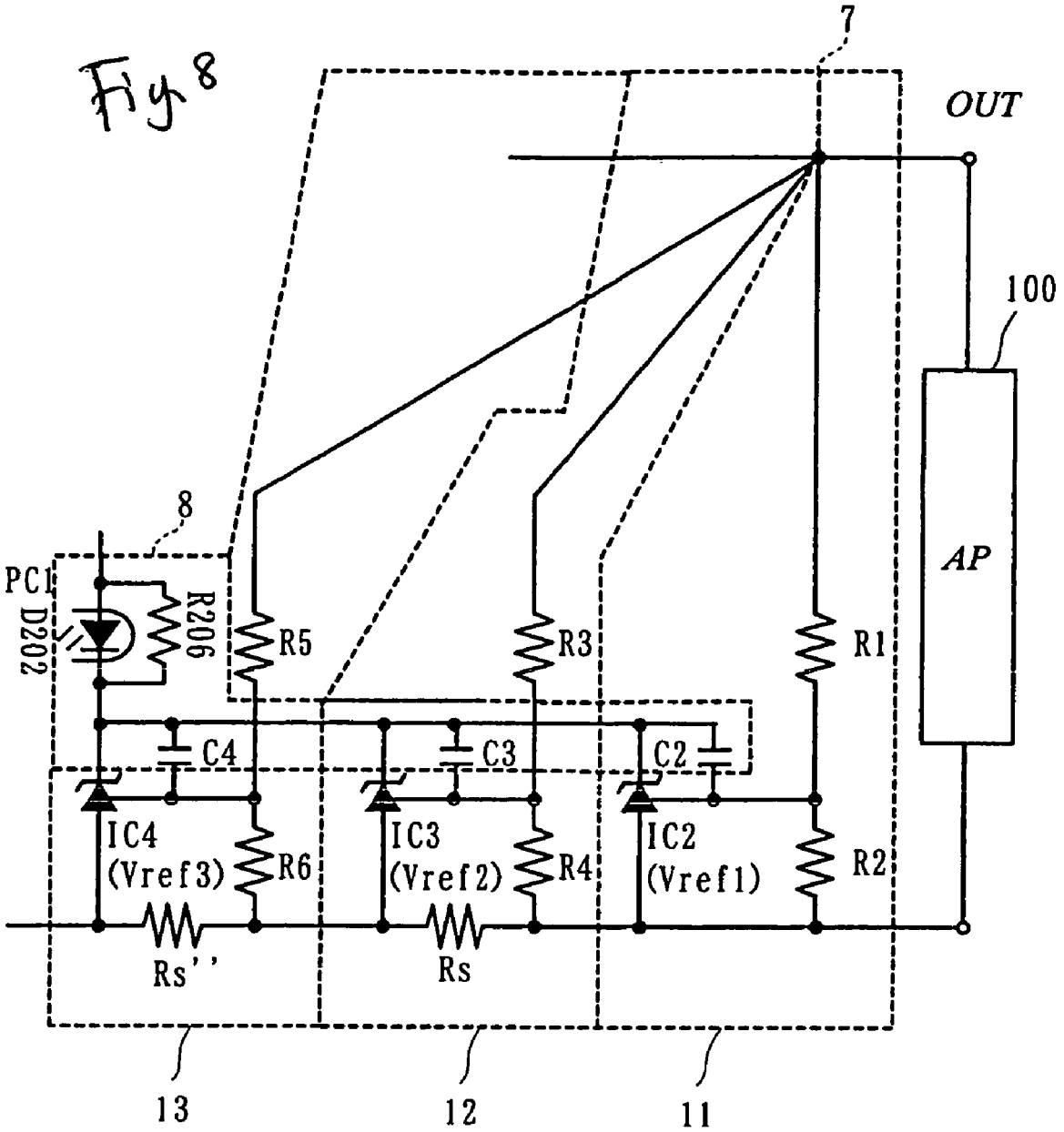
FIG. 8 is a circuit diagram showing a structure in which a voltage variable control circuit is added to a voltage control circuit.
Figure 9:
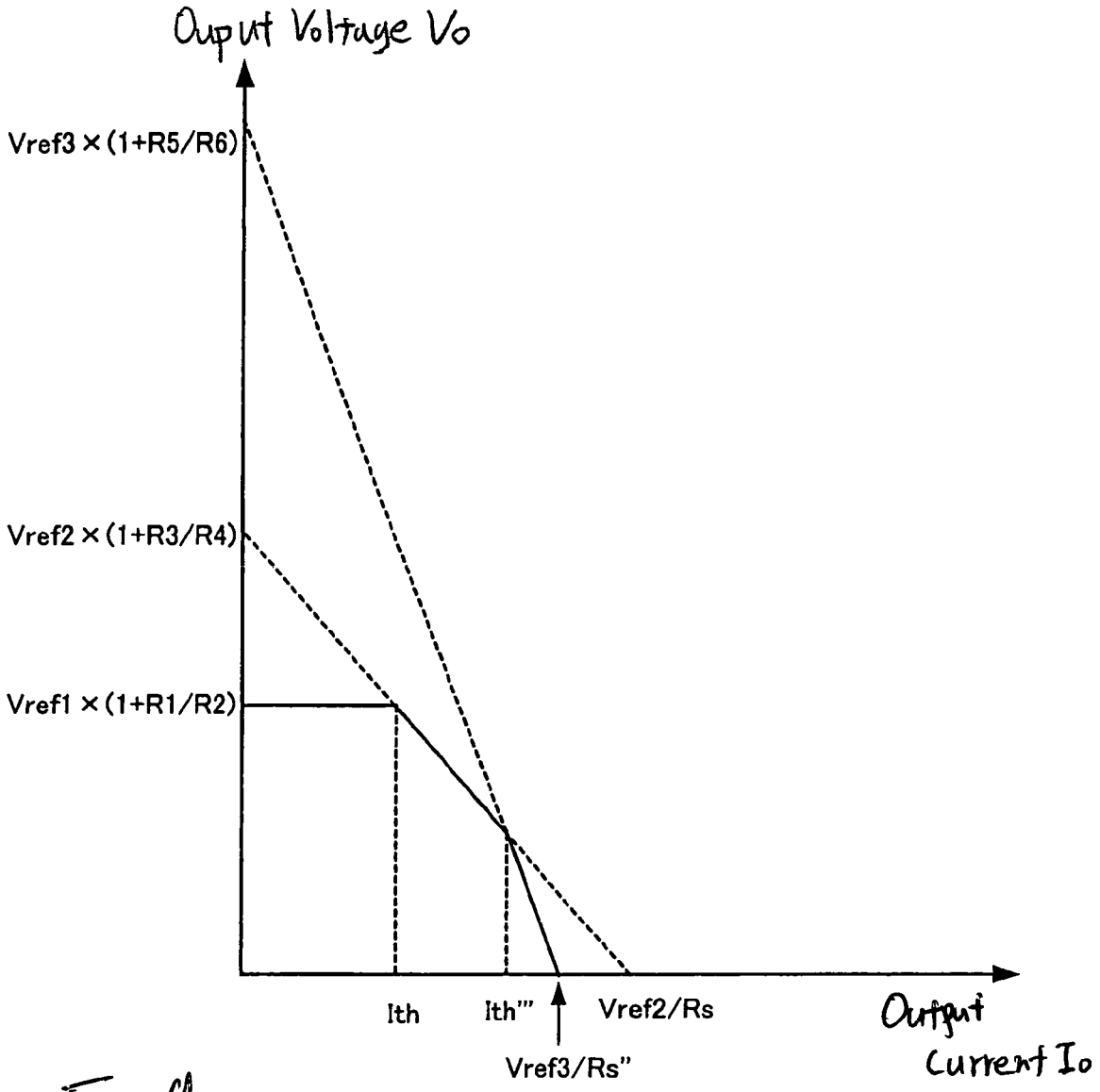
FIG. 9 is a graph showing a relationship between an output current Io and an output voltage Vo in the voltage control circuit illustrated in FIG. 8.

FIG. 8 is a circuit diagram showing a structure in which a voltage variable control circuit is added to a voltage control circuit. FIG. 9 is a graph showing a relationship between an output current Io and an output voltage Vo in the voltage control circuit illustrated in FIG. 8. The voltage control circuit shown in FIG. 8 has such a structure that a voltage variable control circuit 13 is added to the former stage of the voltage variable control circuit 12 in the voltage control circuit 7 illustrated in FIG. 1.

The voltage variable control circuit 13 has the same structure as the structure of the voltage variable control circuit 12, and includes a shunt regulator IC4, a resistor R5, a resistor R6 and a load current detecting resistor Rs". The cathode of the shunt regulator IC4 is connected to the light emitting diode D202 of the photo coupler PC1, and the two resistors R5 and R6 for dividing and applying the output voltage Vo are connected to the reference of the shunt regulator IC4. Moreover, there is provided the load current detecting resistor Rs" connected in series to the load 100 and serving to detect a load current between the anode of the shunt regulator IC4 and the resistor R6. Furthermore, the capacitor C4 having a capacity set to be several μF to several tens μF is connected between the cathode of the shunt regulator IC4 and the reference in order to cause the response of the negative feedback circuit 8 to have a characteristic which is sufficiently delayed from an input AC frequency.

The light emitting diode D202 of the photo coupler PC1 in the negative feedback circuit 8 is connected to the shunt regulator IC4 of the voltage variable control circuit 13. Even if the output voltage of the voltage variable control circuit 13 fluctuates, therefore, it is fed back to the PWM control circuit 9 by the photo coupler PC1. The output voltage of the voltage variable control circuit 13 is determined by a reference voltage Vref3 of the shunt regulator IC4, the two resistors R5 and R6 for dividing and applying the output voltage Vo to the reference of the shunt regulator IC4, the load current detecting resistor Rs" and the output current Io, and Vo=(Vref3−Io×Rs")×(1+R5/R6) is obtained. In other words, the output voltage Vo is decreased in proportion to an increase in the output current Io.

Each of the constants of the reference voltage Vref1 and the resistors R1 and R2 in the shunt regulator IC2 of the constant voltage control circuit 11, the reference voltage Vref2 and the resistors R3 and R4 in the shunt regulator IC3 of the voltage variable control circuit 12, and the reference voltage Vref3 and the resistors R5 and R6 in the shunt regulator IC4 of the voltage variable control circuit 13 is set to obtain the following expression.

$$V\mathrm{ref}3\times(1+R5/R6)>V\mathrm{ref}2\times(1+R3/R4)>V\mathrm{ref}1\times(1+R1/R2)$$

$$V\mathrm{ref}2/Rs>V\mathrm{ref}3/Rs''$$

As shown in FIG. 3, consequently, there is acquired a characteristic within a range in which an output current is 0≦Io≦Vref3/Rs". More specifically, the constant voltage Vo is obtained as Vo=Vref1×(1+R1/R2) when the output current Io is equal to or smaller than the threshold current Ith, and the output voltage Vo is decreased in proportion to an increase in the output current Io based on an equation of Vo=(Vref2−Io×Rs)×(1+R3/R4) when the output current Io exceeds the threshold current Ith and is equal to or smaller than the threshold current Ith". Furthermore, there is obtained a characteristic in which the output voltage Vo is decreased further suddenly in proportion to the increase in the output current Io based on an equation of Vo=(Vref3−Io×Rs")×(1+R5/R6) when the output current Io exceeds the threshold current Ith".

By adding the voltage variable control circuit 13 to the former stage of the constant voltage control circuit 11, thus, it is possible to control the output voltage Vo more finely. Even if the output current Io is increased as in the output characteristic of a power device using an actual low frequency power transformer, accordingly, a constant voltage output is obtained for awhile. However, this structure is suitable for the case in which the reduction rate of the output voltage Vo is to be changed in two stages in proportion to the increase in the output current Io.

The threshold current Ith represents a current on an intersecting point of Vo=Vref1×(1+R1/R2) and Vo=(Vref2−Io×Rs)×(1+R3/R4) and the threshold current Ith"' represents a current on an intersecting point of Vo=(Vref2−Io×Rs)×(1+R3/R4) and Vo=(Vref3−Io×Rs")×(1+R5/R6).

As described above, the switching power device according to the invention does not require a countermeasure to be taken against a power harmonic, and can have the same output characteristic as that of a power device using a low frequency power transformer, and a size can be more reduced as compared with the power device using the low frequency power transformer. Therefore, the switching power device is suitable for a power device for an audio amplifier.

While the above description has been given by taking, as an example, the case in which the reduction rate of an output voltage is increased stepwise with an increase in an output current, the invention is not restricted thereto but another pattern may be employed. For example, setting may be carried out in such a manner that the reduction rate of an output voltage is 0% in a light load, the reduction rate of the output voltage is A % in a middle load, and the reduction rate of the output voltage is B % (<A) in a heavy load. By regulating the value of each component in a voltage variable control circuit, it is possible to obtain a switching power device having a desirable characteristic.

What is claimed is:

1. A switching power device comprising:

a rectifier circuit for rectifying an input AC voltage;

a non-capacitor flyback converter circuit for switching an input voltage applied to a primary winding of a transformer by a switching element without carrying out smoothing after executing the rectification by the rectifier circuit and for rectifying and smoothing a switching voltage induced to a secondary winding of the transformer by a rectifier element and a capacitor, thereby outputting it to a load;

a negative feedback circuit for feeding back a fluctuation in an output current to be supplied to the load to the non-capacitor flyback converter circuit at a lower speed than an input AC frequency; and a voltage control circuit for dropping an output voltage to be applied from the non-capacitor flyback converter circuit to the load with an increase in an output current and for changing a reduction rate stepwise with the increase in the output current.

2. The switching power device according to claim 1, wherein the voltage control circuit comprises:

a constant voltage control circuit including a first shunt regulator having a reference voltage Vref1 and two resistors R1 and R2 for dividing and applying the output voltage to a reference of the first shunt regulator; and a voltage variable control circuit including a second shunt regulator having a reference voltage Vref2, two resistors R3 and R4 for dividing and applying an output voltage to a reference of the second shunt regulator, and a load current detecting resistor Rs connected in series to a load and serving to detect the load current between an anode of the second shunt regulator and the resistor R4, the negative feedback circuit includes a first capacitor connected between a cathode of the first shunt regulator and the reference and a second capacitor connected between a cathode of the second shunt regulator and the reference, the constant voltage control circuit is connected to a latter stage of the voltage variable control circuit, and each of constants of the constant voltage control circuit and the voltage variable control circuit is set as follows:

$$V\text{ref}2\times(1+R3/R4)>V\text{ref}1\times(1+R1/R2).$$

3. The switching power device according to claim 2, wherein the constant voltage control circuit and the voltage variable control circuit include a transistor in place of the first shunt regulator or the second shunt regulator.

4. The switching power device according to claim 2, wherein the constant voltage control circuit further includes a load current detecting resistor Rs' connected in series to a load and serving to detect the load current between an anode of the first shunt regulator and the resistor R2.

5. The switching power device according to claim 2, further comprising a second voltage variable control circuit including a third shunt regulator having a reference voltage Vref3, two resistors R5 and R6 for dividing and applying the output voltage to a reference of the third shunt regulator, and a load current detecting resistor Rs" connected in series to a load and serving to detect the load current between an anode of the third shunt regulator and the resistor R6, wherein the negative feedback circuit includes a third capacitor connected between a cathode of the third shunt regulator and the reference, wherein the second voltage variable control circuit is connected to a former stage of the voltage variable control circuit, and wherein each of constants of the second voltage variable control circuit and the voltage variable control circuit is set as follows:

$$V\text{ref}3\times(1+R5/R6)>V\text{ref}2\times(1+R3/R4).$$

6. The switching power device according to claim 1, wherein the voltage control circuit comprises:

a constant voltage control circuit including a first shunt regulator having a reference voltage Vref1 and two resistors R1 and R2 for dividing and applying the output voltage to a reference of the first shunt regulator; and a voltage variable control circuit including a second shunt regulator having a reference voltage Vref2, two resistors R3 and R4 for dividing and applying an output voltage to a reference of the second shunt regulator, and a load current detecting resistor Rs connected in series to a load and serving to detect the load current between an anode of the second shunt regulator and the resistor R4, the negative feedback circuit includes a first capacitor connected between a cathode of the first shunt regulator and the reference and a second capacitor connected between a cathode of the second shunt regulator and the reference, the constant voltage control circuit is connected to a former stage of the voltage variable control circuit, and each of constants of the constant voltage control circuit and the voltage variable control circuit is set as follows:

$$V\text{ref}2\times(1+R3/R4)>V\text{ref}1\times(1+R1/R2).$$

* * * * *